US006810799B2

(12) United States Patent
Schultheis et al.

(10) Patent No.: US 6,810,799 B2
(45) Date of Patent: Nov. 2, 2004

(54) PRINTING MACHINE WITH ADJUSTING DEVICE FOR SYNCHRONIZING THE PHOTOCONDUCTOR AND FEED GUIDES BY MEANS OF A MASTER-SLAVE CONTROLLER

(75) Inventors: Bernd Schultheis, Schwabenheim (DE); Dieter Jung, Daaden (DE); Birgit Lattermann, Ried-Stadt (DE); Hermann Lemm, Dellhofen (DE)

(73) Assignee: Schott Glas, Mainz (DE)

( * ) Notice: Subject to any disclaimer, the term of this patent is extended or adjusted under 35 U.S.C. 154(b) by 0 days.

(21) Appl. No.: 10/363,884

(22) PCT Filed: Sep. 18, 2001

(86) PCT No.: PCT/EP01/10756

§ 371 (c)(1),
(2), (4) Date: Jul. 14, 2003

(87) PCT Pub. No.: WO02/35292

PCT Pub. Date: May 2, 2002

(65) Prior Publication Data

US 2004/0028444 A1 Feb. 12, 2004

(30) Foreign Application Priority Data

Oct. 20, 2000 (DE) ..... 100 52 305

(51) Int. Cl.[7] ..... B41F 5/00; B41F 13/02; B41J 2/385; G03G 21/14

(52) U.S. Cl. ..... 101/216; 101/119; 347/115; 347/116; 347/119; 347/133; 399/78

(58) Field of Search ..... 101/216, 219; 347/133, 115, 119, 116; 399/78, 301, 200, 208, 303; 355/55

(56) References Cited

U.S. PATENT DOCUMENTS

| | | | | | |
|---|---|---|---|---|---|
| 4,391,506 | A | * | 7/1983 | Koide | 399/208 |
| 4,541,709 | A | * | 9/1985 | Kampschreur | 399/162 |
| 4,561,771 | A | * | 12/1985 | Sugiura | 399/208 |
| 4,586,808 | A | * | 5/1986 | Tanimoto et al. | 399/200 |
| 4,678,315 | A | * | 7/1987 | Watanabe | 399/183 |
| 4,719,491 | A | * | 1/1988 | Katoh et al. | 399/75 |
| 4,739,231 | A | * | 4/1988 | Miyata et al. | 318/369 |
| 4,769,673 | A | * | 9/1988 | Tomosada et al. | 399/32 |
| 4,796,054 | A | * | 1/1989 | Maeno et al. | 399/200 |
| 4,928,141 | A | * | 5/1990 | Poehlein et al. | 399/68 |

(List continued on next page.)

FOREIGN PATENT DOCUMENTS

| | | | | |
|---|---|---|---|---|
| EP | 0343066 | * | 11/1989 | G03G/15/00 |
| EP | 0973072 A1 | * | 1/2000 | G03G/15/01 |
| JP | 63259576 | * | 10/1988 | G03G/15/01 |
| JP | 02176673 | * | 9/1990 | G03G/15/00 |

*Primary Examiner*—Andrew H. Hirshfeld
*Assistant Examiner*—Wasseem H. Hamdan
(74) *Attorney, Agent, or Firm*—Pauley Petersen & Erickson

(57) ABSTRACT

A printing machine with an electrophotographic device, having a photoconductor, a photoconductor drive and an illumination device. The electrophotographic unit can be provided with the substrate by a feed device. The photoconductor drive motor is adjusted by a controller and the feed device can be linearly adjusted by a feed device drive motor. In order to produce high-definition prints, especially images or lettering on plate-shaped substrates, the feed device drive motor is adjusted by a controller that is controlled by a master-slave controller via a setpoint feed. The controller for the photoconductor drive motor is also controlled by the master-slave controller via a setpoint feed and the master slave controller synchronizes the feeding speed of the feed device and the speed of movement of the photoconductor.

9 Claims, 1 Drawing Sheet

U.S. PATENT DOCUMENTS 4,947,209 A * 8/1990 Maeno et al. ..... 399/78
5,086,319 A * 2/1992 Carolan ..... 399/396
5,101,232 A * 3/1992 Evans et al. ..... 399/160
5,130,748 A * 7/1992 Tanaka ..... 399/16
5,151,717 A * 9/1992 Jamzadeh et al. ..... 347/119
5,235,392 A * 8/1993 Hediger ..... 399/76
5,543,894 A * 8/1996 Carolan ..... 399/78
6,137,981 A * 10/2000 Janssens et al. ..... 399/301
6,456,808 B1 * 9/2002 Chen et al. ..... 399/167

* cited by examiner

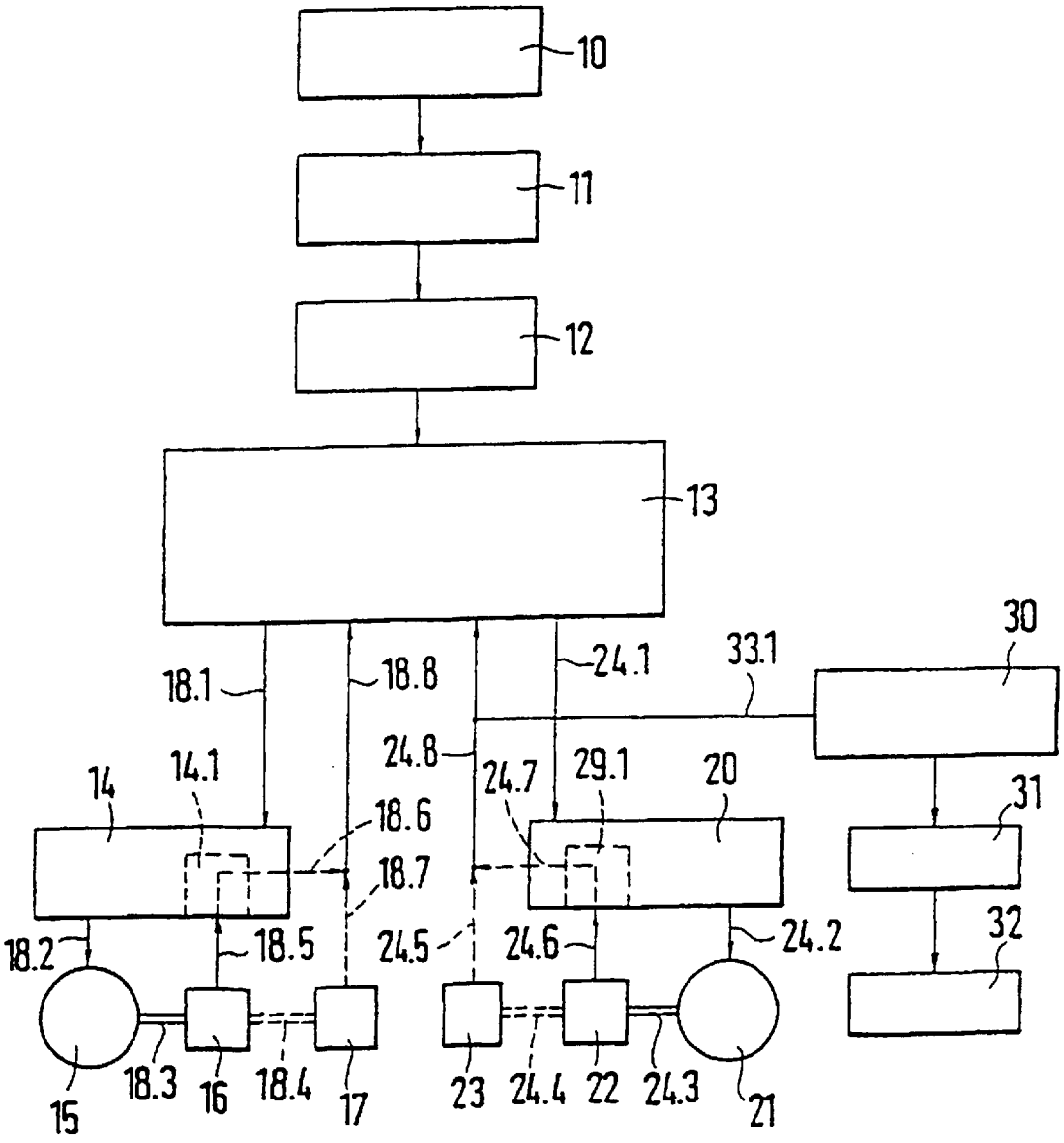
10
11
12
13
30
33.1
18.1
18.8
24.1
24.8
24.7
29.1
20
14
14.1
18.6
18.7
31
18.2
18.5
24.5
24.6
24.2
32
15
18.3
16
18.4
17
23
24.4
22
24.3
21

PRINTING MACHINE WITH ADJUSTING DEVICE FOR SYNCHRONIZING THE PHOTOCONDUCTOR AND FEED GUIDES BY MEANS OF A MASTER-SLAVE CONTROLLER

BACKGROUND OF THE INVENTION

1. Field of the Invention

This invention relates to a printing device, having an electro-photographic arrangement having a photoconductor, to which a photoconductor drive motor and an exposure unit are assigned, and having a conveying device for the substrate to be imprinted, to which a conveying device drive motor is assigned, wherein the photoconductor drive motor and the conveying device drive motor can each be controlled by a control device and can be adjusted for a rotary motion and conveying motion of identical lengths, which are matched to each other.

2. Discussion of Related Art

Such printing devices are known from Patent Abstracts of Japan, vol. 013, no. 073 (P-830), Feb. 20, 1989 (Feb. 20, 1989) and Japanese Patent Reference 63 259576 A (Ricoh Co., Ltd), Oct. 26, 1988 (Oct. 26, 1988), as well as from U.S. Pat. No. 5,543,894. Although a synchronization of several movement sequences in these known printing devices is achieved, this requires either an elaborate control installation with individually adjustable set value transducers, or a central master controller, wherein the guide function is provided to a closed control loop of one drive mechanism, which in the end does not assure an equal influence of the printing process in all control loops.

As European Patent Reference EP 0 973 072 A1 shows, it is also known in connection with such a printing device to regulate the transporting speed of a conveyor belt for the substrate to be imprinted to a constant speed, and during this to scan time markers, which are fixedly applied to the conveyor belt.

Finally, a printing device can be found in Patent Abstract of Japan, vol,. 014, no. 445 (P-1110), Sept. 25, 1990 (Sept. 25, 1990), and Japanese Patent Reference 02 176673 A (Ricoh Ltd. ), July 9, 1990 (July 9, 1990), wherein drive motors for the photoconductor and a transport device are also provided. Here, one drive motor is assigned the guide role. Reference signals are derived from this drive mechanism, by which the other drive mechanisms are synchronized.

SUMMARY OF THE INVENTION

It is one object of this invention to provide a printing device of the type mentioned above but wherein the synchronization of the drive mechanisms occur along with an equal guide roll, and the common central control leads to clear, easily adjustable control devices.

According to this invention, this object is achieved with an incremental transducer or a pulse former assigned to each one of the photoconductor drive motor and the conveying device drive motor. By way of signaling paths the incremental transducers or the pulse formers provide the actual value signals of the motor for the rotary movement of the photoconductor drive motor and the conveying movement of the conveying device drive motor to a common master-slave controller, which adjusts the control devices of the photoconductor drive motor and the conveying device drive motor to a rotary speed and conveying speed which are matched to each other, synchronizes them and provides the control devices of the photoconductor drive motor and the conveying device drive motor with appropriate control signals via set/actual value feed lines. The writing speed for the exposure device assigned to the photoconductor is also derived from the regulated control signal fed back from the photoconductor drive motor.

Both drive mechanisms provide actual motor values to the common master-slave controller independently of each other which, knowing the drive circuits and associated control devices, issues control signals which are synchronized and matched to the drive circuits. The setting to a set value takes place centrally in the master-slave controller, and both drive systems are treated equally.

The design of the drive circuits of this invention is simple and clear.

The control can be performed simply in such a way that the control devices of the photoconductor drive motor and the conveying device drive motor regulate the motor voltage.

In accordance with one embodiment, for the derivation of simple-to-represent motor actual values the motor actual value signals of the photoconductor drive motor and the conveying device drive motor can be derived by resolvers, which electrically control the assigned pulse formers.

If incremental transducers are used, the incremental transducers are mechanically coupled with the photoconductor drive motor and the conveying device drive motor.

The master-slave controller permits a simple presetting of operating data, because the master-slave controller has an interface for a programming field, or its own programming field, by which the control parameters for the control devices can be input and changed.

According to further embodiment, for setting the exposure device the control signal from the master-slave controller for the photoconductor drive motor can be provided to the exposure device processed by a personal computer and a controller.

BRIEF DESCRIPTION OF THE DRAWING

This invention is explained in greater detail in view of an exemplary embodiment represented in the drawing which shows a wiring diagram of a control arrangement for an electro-photographic copier.

DESCRIPTION OF THE PREFERRED EMBODIMENTS

Figure 1:
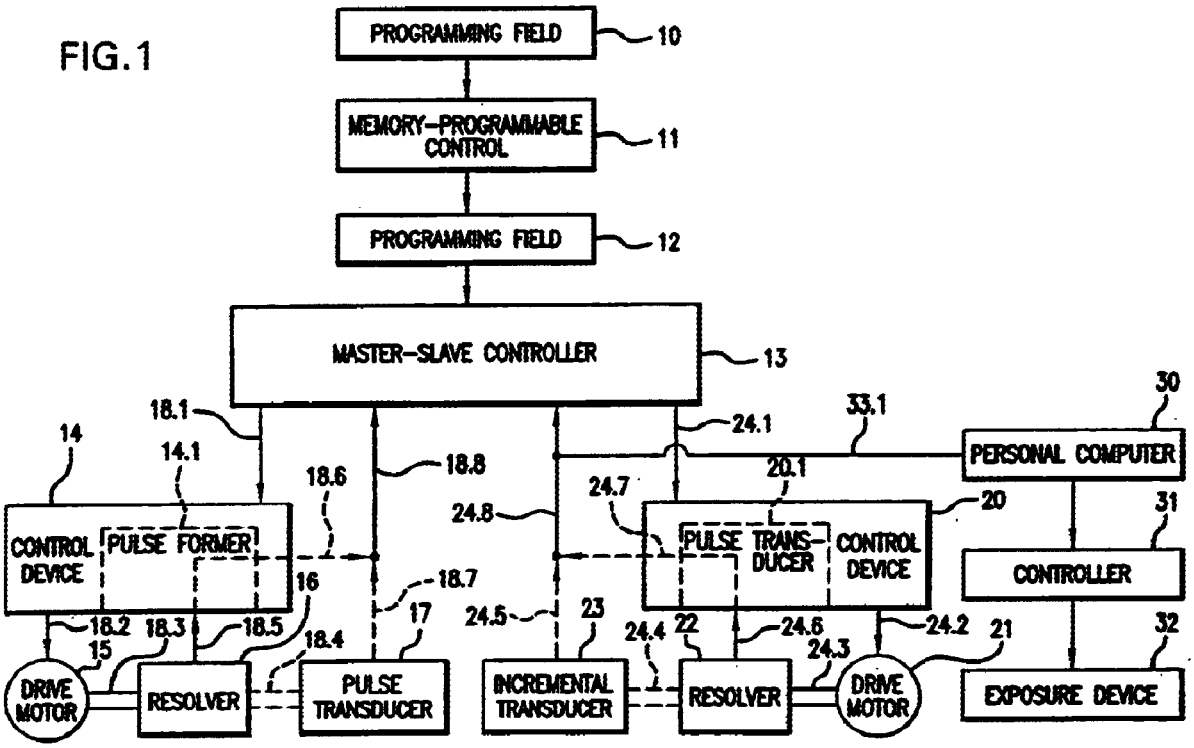

The control arrangement has a programming field 10, by means of which an SPS 11 (memory-programmable control) can be set. The SPS 11 is in contact with a master-slave controller 14. A further programming field 12 is assigned to the master-slave controller 13. Via the programming field 12 it is possible to program the master-slave controller 13 with various control parameters. A control device 14 is connected with the master-slave controller 13 via a set value feed line 18.1. In turn, a drive motor 15 of the conveying device is assigned to the control device 14. The motor 15 is connected to the control device 14 via a motor control line 18.2 and is thereby provided with a voltage. A resolver 16 is mechanically connected to the drive motor 15 of the conveying device, for which a resolver drive mechanism 18.3 is used. The resolver 16 is in contact with an incremental transducer and/or pulse former 14.1 via the signaling path 18.5. This incremental transducer and/or pulse former 14.1 is assigned to the control device 14 and can be electrically programmed.

A signal line 18.6 branches off the incremental transducer and/or pulse former 14.1 which is in electrical contact with an actual value feed line 18.8. This actual value feed line 18.8 is conducted to the master-slave controller 13. Alternatively to the incremental transducer and/or pulse former 17, which is mechanically coupled with the resolver 16 via a pulse transducer drive mechanism 18.4. Here, the pulse transducer 17 is in contact with the actual value feed line 18.8 via the signal line 18.7

The same as the drive motor 15 of the conveying device, the drive motor 21 of the photoconductor device is in control contact with the master-slave controller 13. In this case the control circuits of the drive motor 15 of the conveying device and the drive motor 21 of the photoconductor device are identically designed. Thus, a set value is fed by the master-slave controller 13 to a control device 20 via a set value feed line 24.1. The regulator 20 controls the drive motor 21 of the photoconductor device via the motor control line 24.2. The motor in turn is in contact with a resolver 22 via a resolver drive mechanism 24.3. Via a set value feed line 24.8, the resolver 22 is in contact with an incremental transducer and/or pulse former 20.1, which is assigned to the regulator 20 via a signal line 24.6, or via an incremental transducer and/or pulse former 23, which is coupled to the resolver 22 via a pulse transducer drive mechanism 24.4. The set value feed line 24.8 is finally connected to the master-slave controller 13.

A control line 33.1 is branched off the actual value feed line 24.8 and leads to a personal computer 30. The personal computer 30 controls a controller 31. The controller 31 in turn controls an exposure unit 32.

In the present control diagram, a master signal is fed by the master-slave controller to the control device 20 via the set value feed line 24.1. which supplies the drive motor 21 of the photoconductor with electrical current in accordance with this master signal via the motor control line 24.2. The resolver 22 feeds the actual motor speed in the form of sine pulses back to the pulse transducer 20.1 or 23. The pulses generated by the pulse transducer 20.1 or 23 provide the master-slave controller with information regarding the actual motor speed of the drive motor 21 of the photoconductor. The master-slave controller 13 controls the drive motor 15 of the conveying device on the basis of its knowledge of the speed of the drive motor of the photoconductor. Thus it is possible to synchronize the speed of the drive motor 15 of the conveying device in respect to the speed of the drive motor 21 of the photoconductor.

The control line 33.3 accesses the actual value feed line 24.8. It is thus possible to process the actual speed value of the drive motor 21 of the photoconductor in the personal computer 30 and the controller 31. Finally, it is possible with this arrangement to adjust the writing speed of the exposure unit 32 as a function of the speed of the drive motor 21 of the photoconductor.

With rotary screen printing presses it is possible to adjust, instead of the exposure unit 32, the doctor blade parameters, such as contact pressure, setting angle, as a function of the position and speed by means of the signal via the control line 33.1 and an appropriate controller.

What is claimed is:

1. In a printing device having an electro-photographic arrangement with a photoconductor to which a photoconductor drive motor and an exposure unit are assigned, and having a conveying device for a substrate to be imprinted, to which a conveying device drive motor is assigned, wherein the photoconductor drive motor and the conveying device drive motor each is controlled by a control device and can be adjusted for a rotary movement and a conveying movement of identical lengths matched to each other, the improvement comprising:

one of an incremental transducer (23 and 17) and a pulse former (20.1 and 14.1) assigned to each of the photoconductor drive motor (21) and the conveying device drive motor (15), via signaling paths (24.8 and 18.8) one of the incremental transducer (23 and 17) and the pulse former (20.1 and 14.1) provides the actual value signals of a motor for the rotary movement of the photoconductor drive motor (21) and the conveying movement of the conveying device drive motor (15) to a common master-slave controller (13) which adjusts control devices (20 and 14) of the photoconductor drive motor (21) and the conveying device drive motor (15) to a rotary speed and a conveying speed matched to each other, synchronizes them and provides the control devices (20 and 14) of the photoconductor drive motor (20) and the conveying device drive motor (15) with appropriate regulated control signals via set/actual value feed lines (24.1 and 18.1), and a writing speed for an exposure device (32) assigned to the photoconductor and being received from the regulated control signal fed back from the photoconductor drive motor (20).

2. In the printing device in accordance with claim 1, wherein the control devices (20 and 14) each respectively controls a motor voltage of the photoconductor drive motor (21) and the conveying device drive motor (15).

3. In the printing device in accordance with claim 2, wherein motor actual value signals of the photoconductor drive motor (21) and the conveying device drive motor (15) are derived by resolvers (22 and 16) which electrically control the pulse formers (20.1 and 14.1).

4. In the printing device in accordance with claim 3, wherein the incremental transducer (23 and 17) is mechanically coupled with the photoconductor drive motor (21) and the conveying device drive motor (15).

5. In the printing device in accordance with claim 4, wherein the master-slave controller (13) has one of an interface for a programming field (12) and an independent programming field by which control parameters for the control devices (20 and 14) can be input and varied.

6. In the printing device in accordance with claim 1, wherein the control signals from the master-slave controller (13) for the photoconductor drive motor (21) are provided to the exposure unit (32), and are processed by a personal computer (30) and a controller (31).

7. In the printing device in accordance with claim 1, wherein motor actual value signals of the photoconductor drive motor (21) and the conveying device drive motor (15) are derived by resolvers (22 and 16) which electrically control the pulse formers (20.1 and 14.1).

8. In the printing device in accordance with claim 1, wherein the incremental transducer (23 and 17) is mechanically coupled with the photoconductor drive motor (21) and the conveying device drive motor (15).

9. In the printing device in accordance with claim 1, wherein the master-slave controller (13) has one of an interface for a programming field (12) and an independent programming field by which control parameters for the control devices (20 and 14) can be input and varied.

* * * * *

UNITED STATES PATENT AND TRADEMARK OFFICE

CERTIFICATE OF CORRECTION

PATENT NO. : 6,810,799 B2
DATED : November 2, 2004
INVENTOR(S) : Bernd Schultheis et al.

It is certified that error appears in the above-identified patent and that said Letters Patent is hereby corrected as shown below:

Drawings,
Replace FIG. 1 with the attached FIG. 1.

Signed and Sealed this

Seventeenth Day of January, 2006

JON W. DUDAS
*Director of the United States Patent and Trademark Office*